US012569039B2

(12) United States Patent
Kawabe et al.

(10) Patent No.: US 12,569,039 B2
(45) Date of Patent: Mar. 10, 2026

(54) BAND AND TIMEPIECE

(71) Applicant: SEIKO EPSON CORPORATION, Tokyo (JP)

(72) Inventors: Genta Kawabe, Matsumoto (JP); Hideo Kato, Shiojiri (JP)

(73) Assignee: SEIKO EPSON CORPORATION (JP)

( * ) Notice: Subject to any disclaimer, the term of this patent is extended or adjusted under 35 U.S.C. 154(b) by 605 days.

(21) Appl. No.: 17/960,897

(22) Filed: Oct. 6, 2022

(65) Prior Publication Data

US 2023/0116224 A1 Apr. 13, 2023

(30) Foreign Application Priority Data

Oct. 7, 2021 (JP) ..... 2021-165346

(51) Int. Cl.
*A44C 5/00* (2006.01)

(52) U.S. Cl.
CPC ..... *A44C 5/0053* (2013.01)

(58) Field of Classification Search
None
See application file for complete search history.

(56) References Cited

U.S. PATENT DOCUMENTS 4,700,874 A * 10/1987 Mock ..... A44C 5/0053 63/3

FOREIGN PATENT DOCUMENTS

| | | | |
|---|---|---|---|
| CN | 103226323 | A | 7/2013 |
| JP | 2006-334308 | A | 12/2006 |
| JP | 2007-143812 | A | 6/2007 |
| JP | 2015-053971 | A | 3/2015 |

OTHER PUBLICATIONS

UKWatchstrap, Double Stud Brown Calf Leather Watch Strap (Year: 2012).*
Findtime, Womens Digital Watch Sport Waterproof Watch Analog Military Tactical Watches LED Backlight Alarm Stopwatch Wrist Watches (Year: 2021).*

* cited by examiner

*Primary Examiner* — Renee S Luebke
*Assistant Examiner* — Matthew Daniel Hwang
(74) *Attorney, Agent, or Firm* — Harness, Dickey & Pierce, P.L.C.

(57) ABSTRACT

Provided is a timepiece including a band, and a main body portion having a bow engaged with the band. The timepiece includes a leg portion that comes into contact with a placing surface in a vicinity of a part where the band and the bow are engaged with each other when the timepiece is placed with the band facing downward in a state in which the body part is standing.

10 Claims, 6 Drawing Sheets

BAND AND TIMEPIECE

The present application is based on, and claims priority from JP Application Serial Number 2021-165346, filed Oct. 7, 2021, the disclosure of which is hereby incorporated by reference herein in its entirety.

BACKGROUND

1. Technical Field

The present invention relates to a band and a timepiece including the band.

2. Related Art

For example, Japanese Unexamined Patent Publication No. 2006-334308 discloses a timepiece that can be used as a table clock and also as a wristwatch. According to Japanese Unexamined Patent Publication No. 2006-334308, the timepiece is composed of a timepiece main body and one wire band having elasticity, two coupling portions for coupling the timepiece main body and the wire band are provided at diagonal portions of the timepiece main body, and the wire band is formed in a Mobius curve shape extending in opposite directions along the timepiece main body from the respective coupling portions. when wearing the timepiece, the user only has to put the arm through the wire band, and when the timepiece is removed, it can be used as a table clock by placing it on a table as it is.

However, the wristwatch disclosed in Japanese Unexamined Patent Publication No. 2006-334308 has a problem that it is not easy to use. Specifically, since a single wire is used as a band, when the timepiece is placed on a flat surface such as a desk, the curved portion of the wire wobbles and it is difficult to stably place the timepiece. In addition, when used as a wristwatch, the timepiece with wire does not provide comfortable fit.

In other words, there is a demand for a timepiece that is easy to use both as a wristwatch and as a table clock.

SUMMARY

The time piece according to an aspect of the disclosure includes:

a band; and a body portion having a bow configured to be engaged with the band, wherein the timepiece includes a leg portion that comes into contact with a placement surface in a vicinity of a part where the band and the bow are engaged with each other when the timepiece is placed with the band facing downward in a state in which the main body portion is standing.

A band according to an aspect of the disclosure is a band engaged with a body portion having a bow, the band including a leg portion that comes into contact with a placement surface in a vicinity of a part where the band and the bow are engaged with each other when the timepiece is placed with the band facing downward in a state in which the main body portion is standing.

DESCRIPTION OF EXEMPLARY EMBODIMENTS

First Embodiment

Overview of Timepiece

Figure 1:
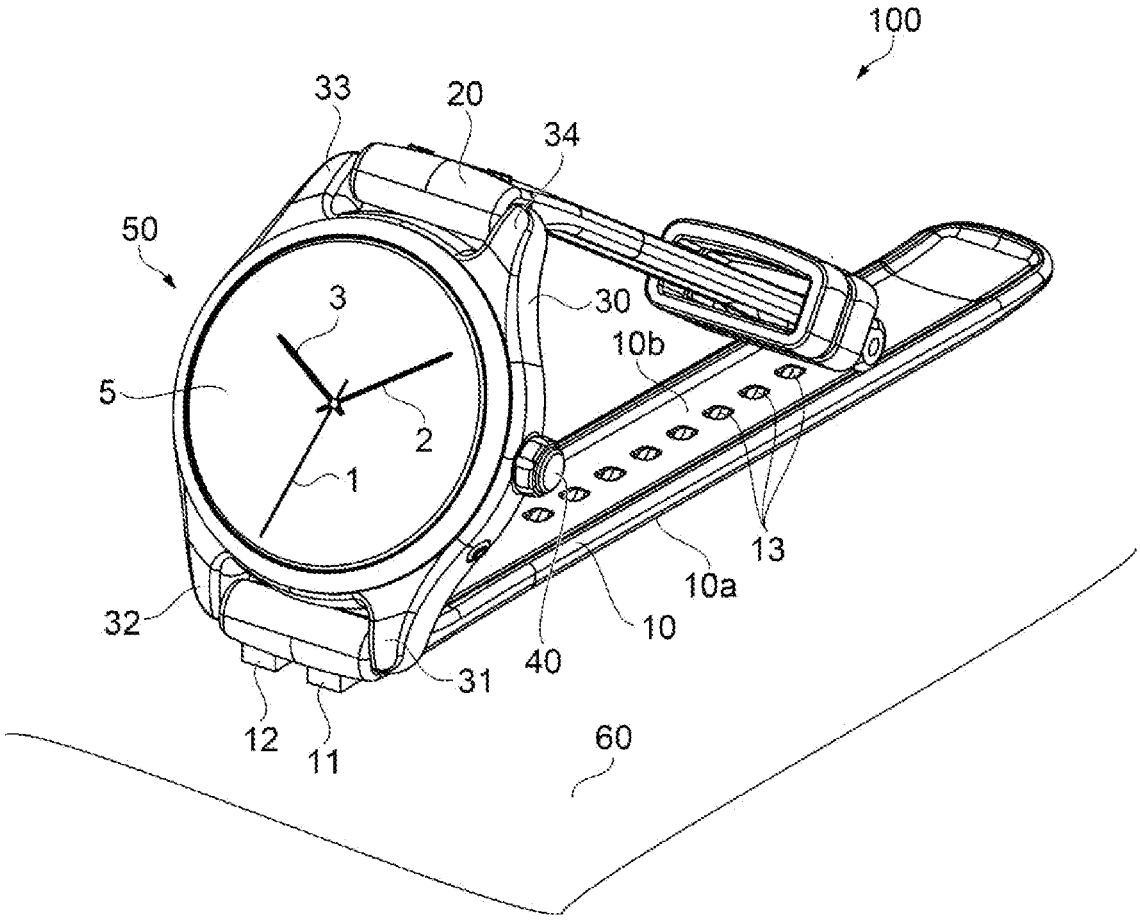
FIG. 1 is a perspective view of a timepiece according to Embodiment 1.
Figure 2:
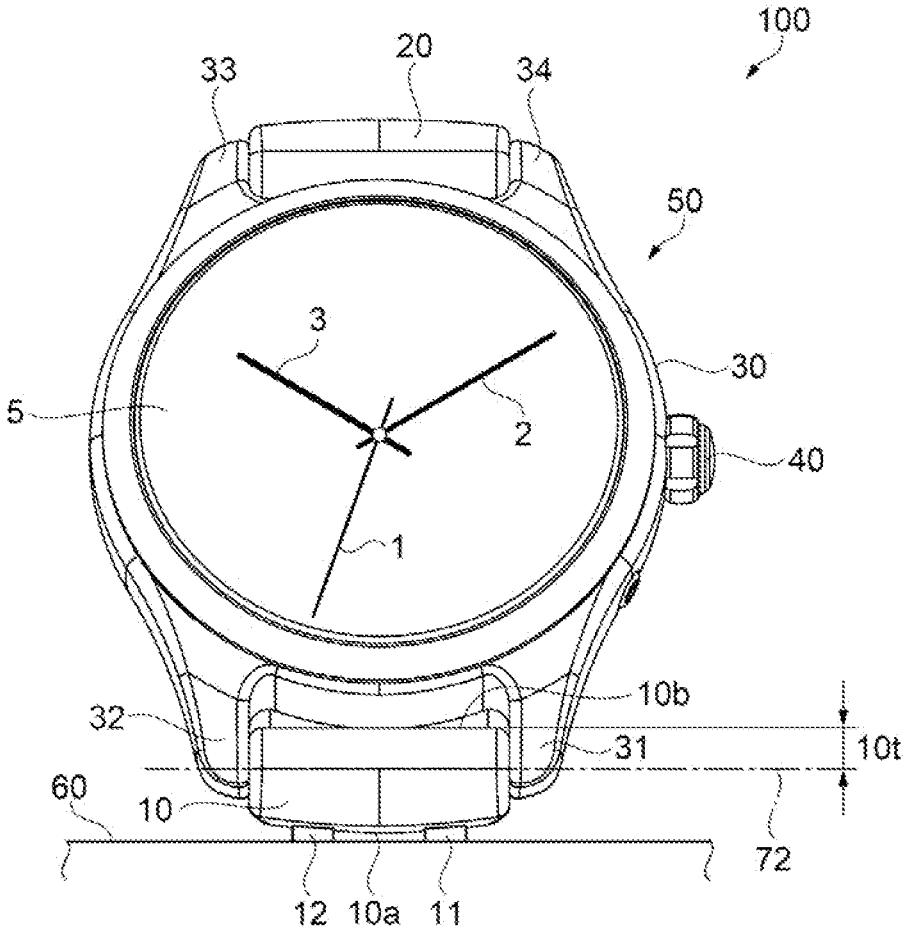
FIG. 2 is a front view of the timepiece.

FIG. 1 is a perspective view of a time piece according to an embodiment. FIG. 2 is a front view of a state of a table clock.

The timepiece 100 of the present embodiment is a three hand analog timepiece, and can be used as a wristwatch when worn on an arm using a band 10, 20. In addition, as shown in FIG. 1, when the timepiece is placed on a desk or the like with the band 10 facing downward in a state where the main body 50 is standing, the timepiece can be used as a table clock. In particular, since a pair of leg portions 11,12 are provided in the width direction of the band 10, the main body portion 50 can be placed in a stable state. Note that the timepiece is not limited to an analog timepiece, and may be any timepiece that displays time in a normal state, and may be, for example, a digital timepiece, an analog/digital mixed timepiece, or a hybrid timepiece.

The timepiece 100 includes a main body portion 50 which is a main body of the timepiece, a band 10 attached on the 6 o'clock side, a band 20 attached on the 12 o'clock side, and the like.

The main body 50 includes a barrel 30, a dial 5, a second hand 1, a minute hand 2, an hour hand 3, a crown 40, and the like. The timepiece 100 indicates time with the hour hand 3, the minute hand 2, and the second hand 1. The crown 40 is provided on the 3 o'clock side, and when pulled by one step, the time can be corrected.

The barrel 30 is a case, and is made of hard metal such as stainless steel or titanium, or resin such as plastic. A movement (not shown) for driving the hands is housed on the back side of the dial 5 in the barrel 30. A windshield glass and a back cover are also attached to the barrel 30, but are not shown in the drawings.

The barrel 30 is provided with a pair of bows 31,32 for attaching the band 10 and a pair of bows 33,34 for attaching the band 20.

The bow 31 is a portion protruding from the circular barrel 30, and is provided substantially in the 5 o'clock direction.

Similarly, the bow 32 is provided substantially in the 7 o'clock direction, the bow 33 is provided substantially in the 11 o'clock direction, and the bow 32 is provided substantially in the 1 o'clock direction.

In the band 10, a surface on the same side as the dial 5 is referred to as a front surface 10*a*, and a surface opposite to the front surface 10*a* and in contact with the wrist is referred to as a back surface 10*b*.

Figure 3:
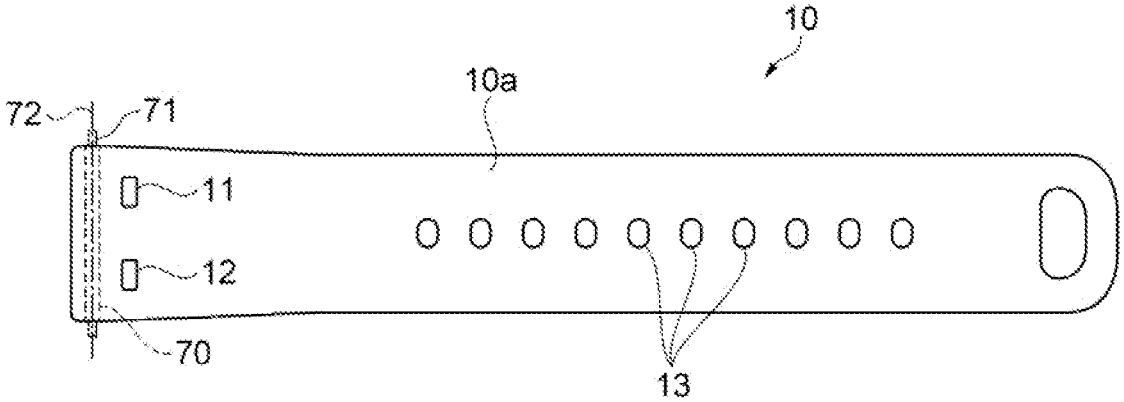
FIG. 3 is a plan view of a band.

FIG. 3 is a plan view of the band 10 from the front surface 10*a* side.

The band 10 is a strap-shaped band to be worn on an arm, and has one end attached to the barrel 30. The one end is provided with a through hole 70 through which a spring rod 71 passes. The spring rod 71 is an attachment pin for attaching the band 10 to the bow 31,32, and an end portion thereof has a spring property. The bows 31,32 are provided with bow holes (not shown) through which the spring rod 71 is inserted. When the band 10 is attached to the bows 31,32 by the spring rod 71, the band 10 is coupled to the barrel 30 as shown in FIG. 1.

Similarly, one end of the band 20 is also attached to the bow 33,34 by a spring rod 71.

Detailed Description of Band and Legs

The other end of the band 20 is provided with a buckle (not shown) which is an attachment fitting, and a rod to which the buckle is attached is inserted into the small hole 13 of the band 10 so that the timepiece can be worn on the arm.

The band 10 is preferably composed of an elastomer. The elastomer is preferably a material that can be injection molded, and for example, a silicone resin or a urethane resin can be used. The same applies to the band 20.

In FIG. 2, a center line 72 is the center line of the spring rod 71.

Here, the dimension 10*t* indicates the band thickness from the center line 72 of the spring rod 71 to the back side 10*b* of the band 10. As shown in FIG. 2, the back surface 10*b* of the band 10 is in contact with the barrel 30, and the dimension from the center line 72 of the spring rod 71 to the barrel 30 is set to be substantially the same as the dimension 10*t*. This is because it is necessary to support the barrel 30 with the thickness of the band 10 so that the main body 50 is in the standing state as shown in FIG. 1. The dimension 10*t* of the band 10 may be appropriately set to a dimension suitable for maintaining the standing state in accordance with the hardness of the band 10 and the weight of the main body 50.

A pair of leg portions 11,12 are provided on the front surface 10*a* of the band 10. The leg portions 11,12 are disposed apart from each other in the width direction of the band 10, and are in contact with the placement surface 60 such as a desk. The leg portions 11,12 are legs formed of a pair of convex portions provided spaced apart from each other with a top portion therebetween on the front surface 10*a* of the band 10 having a curved surface gently bulging in the width direction. In other words, the leg portions 11,12 are convex portions that protrude from the front 10*a* of the band 10. The heights of the leg portions 11,12 are uniform, and the leg portions 11,12 as legs come into contact with the placement surface 60 to support the band 10 and the main body portion 50.

As shown in FIG. 3, the leg portion 11,12 is a convex portion having a rectangular shape in plan view, and a long side thereof is disposed along the width direction of the band 10. The leg portions 11,12 are provided spaced apart along and near the center line 72 of the spring bar 71. In a preferred example, the leg portions 11,12 have a convex shape integrally molded with the main body of the band 10. In other words, the leg portions 11,12 are made of the same material as the band 10.

Returning to FIG. 1.

With such a configuration, when the main body 50 is placed upright on a placement surface 60 such as a desk with the band 10 facing downward, the leg portions 11,12 serve as front legs and the extending portion of the band 10 in which small holes 13 are formed serve as rear legs, whereby the main body 50 can be stably supported. The state in which the main body portion 50 is standing refers to a state in which an angle formed by the placement surface 60 and the dial 5 is an acute angle. In addition, the other end side of the band 20 comes into contact with the back surface 10*b* of the band 10, so that the band 20 functions as a support rod that supports the main body portion 50. Accordingly, a truss shape is formed by the main body portion 50 and the band 20 with the band 10 as a base. At this time, the bows 31,32 are set not to be in contact with the placement surface 60. In other words, the timepiece 100 has the leg portions 11,12 that come into contact with the placement surface 60 in the vicinity of a portion where the band 10 and the bows 31,32 are engaged with each other when the body portion 50 is standing with the band 10 facing downward.

The following advantages can be obtained with the timepiece according to the present embodiments.

The timepiece 100 has leg portions 11,12 which come into contact with the placing surface 60 in the vicinity of a part where the band 10 and the bows 31,32 are engaged with each other when the time piece 100 is placed with the band 10 facing downward in a state where the body part 50 is standing.

Therefore, when the timepiece 100 is placed on the placement surface 60 such as a desk, the timepiece can be placed in a stable manner by providing the leg portions 11,12. In addition, unlike a conventional timepiece for which a wire is used as a band, the timepiece 100 provides comfortable fit because it has the band-shaped band.

Therefore, it is possible to provide the timepiece 100 that is easy to use both as a wristwatch and as a table clock.

In addition, the band 10 has the leg portions 11,12, and the leg portions 11,12 are convex portions protruding from the front surface 10*a* of the band 10.

According to this configuration, since the leg portions 11,12 come into contact with the placement surface 60, damage to the front surface 10*a* of the band 10 can be reduced.

In addition, when the timepiece is placed with the band 10 facing downward in a state where the main body portion 50 is standing, the bows 31,32 do not come into contact with the placement surface 60.

This reduces the damage to the barrel 30 including the bows 31,32.

The leg portions 11,12 are made of the same material as the band 10.

According to this configuration, since the leg portions 11,12 can be formed together in the manufacturing process of the band 10, the number of components can be reduced, and the number of manufacturing steps can also be reduced.

In addition, according to the timepiece 100, when the band 10 is brought to the back surface side of the main body portion 50 and placed on the placement surface 60, the timepiece 100 can be placed stably in the width direction of the band 10.

Thus, it is possible to provide the timepiece 100 which is easy to use both as a wristwatch and as a table clock.

Second Embodiment

Bows as Legs

FIG. 1 is a perspective view of a time piece according to the present embodiment.

In the above-described embodiment, the front legs have been described as the leg portions 11,12 of the band 10, they may be any legs that come into contact with the placement surface 60 in the vicinity of a part where the band 10 and the 31*b* and 32*b* are engaged with each other.

The timepiece 100*b* of the present embodiment is provided with bows 31*b* and 32*b* having longer protruding lengths than the bows 31,32 (FIG. 2) of the first embodiment, and the bow 31*b* and 32*b* are configured to function as front legs. Further, the same constituents as those in the First Embodiment are given the same reference signs, and redundant description of these constituents will be omitted.

Figure 4:
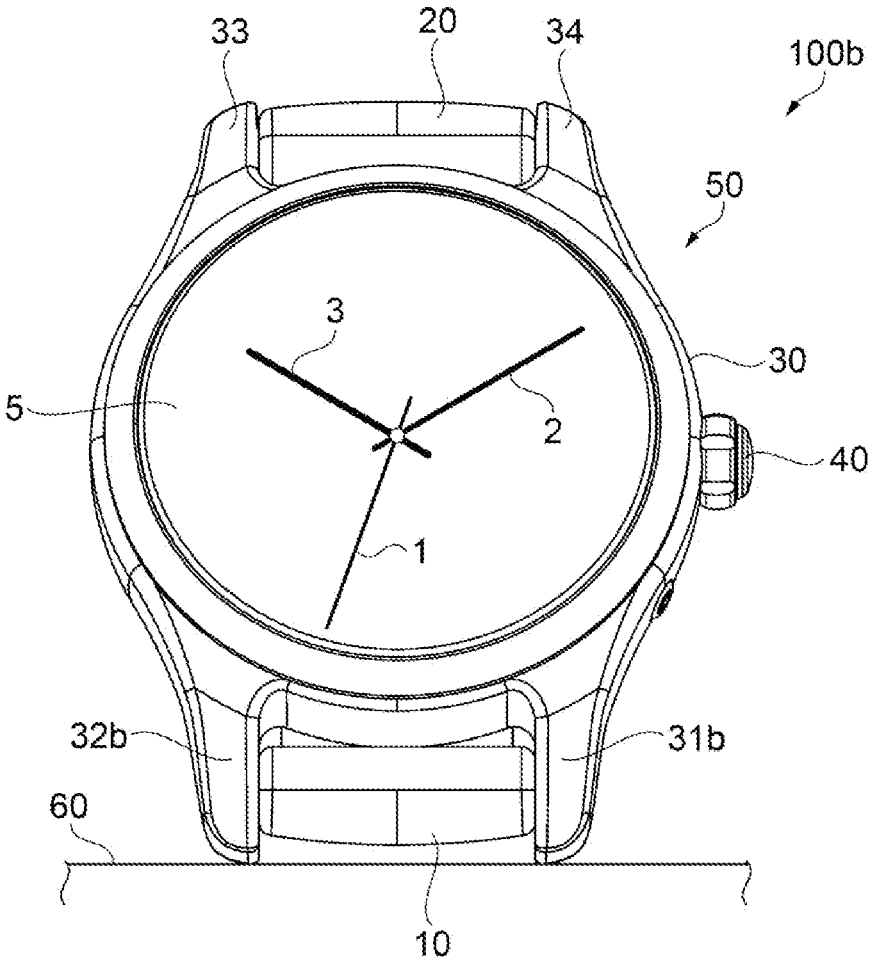
FIG. 4 is a front view of a timepiece according to Second Embodiment.

The bows 31*b* and 32*b* in FIG. 4 have a protruding length from the barrel 30 greater than that of the bows 31,32 in FIG. 2, and are in contact with the placement surface 60. No leg portion is provided on the band 10, and there is a gap between the band 10 and the placement surface 60. That is, the extending portions of the bow 31*b* and 32*b* serve as the leg portions, in other words, the bows 31*b* and 32*b* have the leg portions. The other points are the same as those described in the First Embodiment.

Even with this configuration, when the time piece is placed with the band 10 facing downward in a state where the main body 50 is standing on a desk or the like, the bows 31*b* and 32*b* serve as the front legs and the extending portion of the band 10 in which the small holes 13 are formed serves as the rear legs, making it possible to stably support the main body 50.

As described above, with the timepiece 100*b* according to the present embodiment, the following advantages can be achieved in addition to the advantages described in the First Embodiment.

The timepiece 100*b* is provided with bows 31*b* and 32*b* with the extending portions serving as the leg portions.

According to this configuration, when the timepiece is placed on a desk or the like with the band 10 facing downward in a state in which the main body 50 is standing, the bows 31*b* and 32*b* serve as front legs, and the extending portion of the band 10 in which the small holes 13 are formed serves as a rear leg, making it possible to stably support the main body 50.

Therefore, it is possible to provide a timepiece 100*b* that is easy to use both as a wristwatch and as a table clock.

Third Embodiment

Composite Legs of Convex Portion and Bow

Figure 5:
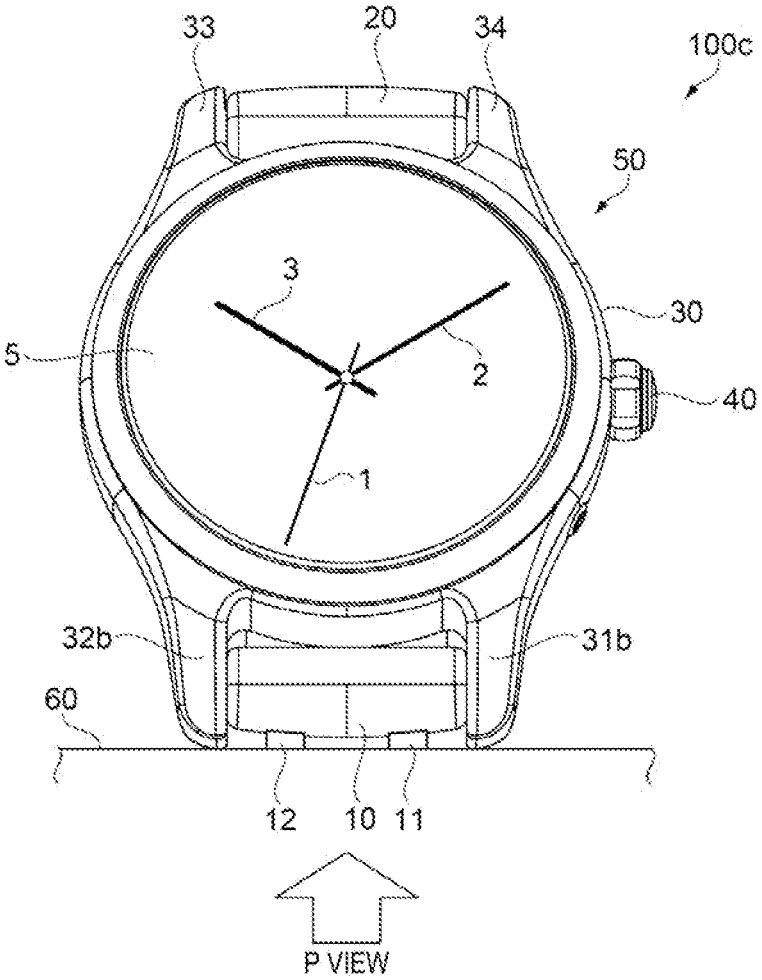
FIG. 5 is a front view of a timepiece according to Third Embodiment.
Figure 6:
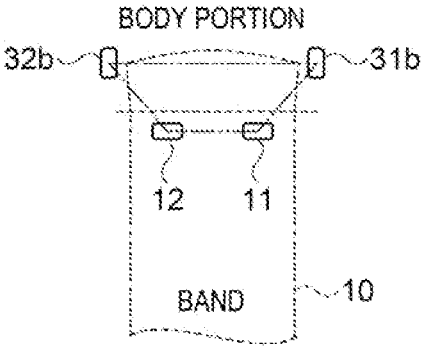
FIG. 6 is an arrangement view of leg portions on a placement surface.

FIG. 5 is a perspective view of the timepiece according to the present embodiment and corresponds to FIGS. 2 and 4. FIG. 6 is a plan view showing a contact state of the leg portions on the mounting surface.

In the embodiment described above, the front legs are two leg portions. However, any plural number of front legs, for example, four front legs may be provided.

In the timepiece 100*c* of the present embodiment, leg portions 11,12 formed by convex portions of the band 10 are also provided in addition to the bows 31*b* and 32*b* functioning as the leg portions of the Second Embodiment. That is, four leg portions are provided as the front legs. Further, the same constituents as those in the First Embodiment are given the same reference signs, and redundant description of these constituents will be omitted.

FIG. 6 is a view in the direction P of FIG. 5, and is a diagram showing a contact state of the four leg portions with the placement surface 60. As shown in FIG. 6, the bows 31*b* and 32*b* are disposed so as to be positioned in front of the main body portion, the leg portions 11,12 are disposed so as to be positioned behind the main body portion, and the four legs are disposed so as to form a trapezoid when coupled by imaginary lines. The other points are the same as those described in the above embodiment.

As described above, with the timepiece 100*c* according to the present embodiment, the following advantages can be achieved in addition to the advantages described in the above embodiment.

A plurality of legs are provided in the timepiece 100*c*. Specifically, the bow 31*b* and the 32*b* are provided in front of the main body portion, and the leg portions 11,12 are provided behind the main body portion. Each of the four leg portions is provided at a vertex of a trapezoid.

According to this configuration, when the main body 50 is placed on a desk or the like with the band 10 facing downward in a state in which the main body 50 is standing, the bow 31*b*, the 32*b*, and the leg portions 11,12 serve as front legs, and the extending portion of the band 10 in which the small holes 13 are formed serves as rear leg, making it possible to stably support the main body 50.

Therefore, it is possible to provide a timepiece 100*c* that is easy to use both as a wristwatch and as a table clock.

Modification Example

FIGS. 7, 8, 9 and 10 are plan views showing different embodiments of the leg portions, and correspond to FIG. 3.

In the above-described embodiment, the leg portions provided on the band 10 are described as the two small rectangular leg portions 11,12, but the leg portions are not limited thereto, and may be any leg portions formed of a convex portion.

Figure 7:
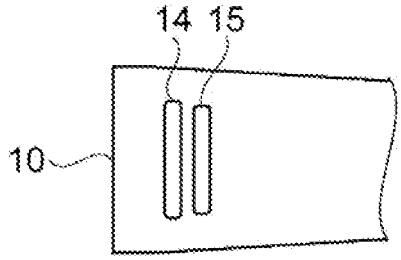
FIG. 7 is a view showing a different embodiment of the leg portions.

For example, the leg portion 14 in FIG. 7 has a bar shape extending along the width direction of the band 10.

A rod-shaped leg portion 15 slightly shorter than the leg portion 14 is provided adjacent to the leg portion 14. The number of the leg portions is not limited to two, and may be three or more.

Figure 8:
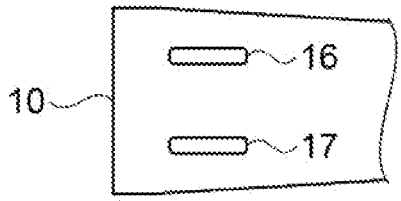
FIG. 8 is a view showing a different embodiment of the leg portions.

The leg portion 16 in FIG. 8 has a rod shape extending along the longitudinal direction of the band 10, and is provided on one side of the band 10. The leg portion 17 has the same bar shape as the leg portion 16 and is provided on the other side of the band 10. The number of the leg portions is not limited to two, and may be three or more.

Figure 9:
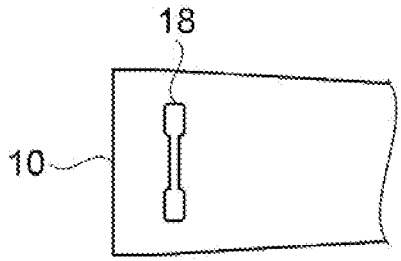
FIG. 9 is a view showing a different embodiment of the leg portions.

The leg portion 18 shown in FIG. 9 has a shape in which the leg portions 11,12 shown in FIG. 3 are coupled by a thin line segment.

The enlarged portions at both ends function as legs. The thin line segments are design accents.

Figure 10:
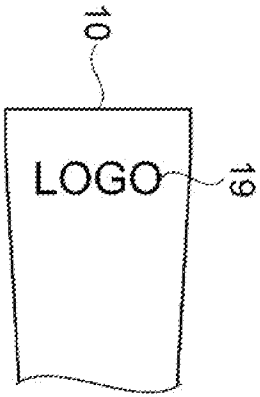
FIG. 10 is a view showing a different embodiment of the leg portion.

Further, the leg portion 19 in FIG. 10 is provided with characters "LOGO" composed of a convex portion as leg portions. The design is not limited to the characters, and, for example, logos such as a product name, a model number, or a brand may be used.

These leg portions can also stably support the main body 50 as the leg portions in the same manner as described above. In addition, since various designs can be applied, the design of the timepiece can be enhanced.

In the above embodiment, the material of the band 10 is elastomer, but is not limited thereto. For example, it may be a band made of leather, fabric, or metal, for example. Such configuration can also achieve effects similar to those in the above-mentioned embodiments.

Further, in the above-described embodiment, the convex portion serving as the leg portion is formed integrally with the band, but the leg portion may be formed of another material. For example, if the material of the band is leather, the legs may be formed by stitching. Alternatively, a silicone leg portion formed separately from the band may be attached to the band. The material is not limited to silicone, but may be any elastic material, for example, rubber or elastomer. In other words, the leg portion may be formed of a material different from that of the band. According to this configuration, since various designs can be applied, the design of the timepiece can be enhanced.

What is claimed is:

1. A timepiece comprising:

a band configured with a first band part and a second band part; and a body portion having a first bow and a second bow, the first band being engaged with the first bow at a 12 o'clock position of the timepiece, the second band being engaged with the second bow at a 6 o'clock position of the timepiece; and a leg portion configured to come into contact with a placement surface when the timepiece is placed on the placement surface with the second band part facing downward in a state in which the body portion is standing, wherein the leg portion is formed only at a first position of the second band part that is located directly adjacent to the second bow as a projection outwardly projecting from the first position.

2. The timepiece according to claim 1, wherein the leg portion is a convex portion.

3. The timepiece according to claim 2, wherein a plurality of the leg portions is provided.

4. The timepiece according to claim 1, wherein, when the timepiece is placed with the second band part facing downward in the state in which the body portion is standing, the second bow is not in contact with the placement surface.

5. The timepiece according to claim 1, wherein the leg portion of the timepiece includes the same material as that of the band.

6. The timepiece according to claim 1, wherein the leg portion of the timepiece includes a material different from that of the band.

7. The timepiece according to claim 1, wherein the band includes any one of elastomer, leather, fabric, and metal.

8. The timepiece according to claim 1, wherein the body portion further includes a barrel as a case of the timepiece, and a back surface of the second band part is in contact with the barrel in the state in which the body portion is standing.

9. A band engaged with a body portion of a timepiece, the body portion having a first bow and a second bow, the band comprising:

a first band part engaged with the first bow at a 12 o'clock position of the timepiece;

a second band part engaged with the second bow at a 6 o'clock position of the timepiece; and a leg portion configured to come into contact with a placement surface when the timepiece is placed on the placement surface with the second band part facing downward in a state in which the body portion is standing, wherein the leg portion is formed only at a first position of the second band part that is located directly adjacent to the second bow as a projection outwardly projecting from the first position.

10. The band according to claim 9, wherein the body portion further includes a barrel as a case of the timepiece, and a back surface of the second band part is in contact with the barrel in the state in which the body portion is standing.

* * * * *